United States Patent [19]

Grant et al.

[11] 4,384,035

[45] * May 17, 1983

[54] PERFORATE DEVELOPMENT ELECTRODE

[75] Inventors: Clyde P. Grant, Gorham; Merton A. Look, Westbrook; Richard M. Lowe, South Portland, all of Me.

[73] Assignee: Scott Paper Company, Philadelphia, Pa.

[ * ] Notice: The portion of the term of this patent subsequent to Aug. 3, 1999, has been disclaimed.

[21] Appl. No.: 275,615

[22] Filed: Jun. 22, 1981

Related U.S. Application Data

[60] Division of Ser. No. 66,395, Aug. 14, 1979, Pat. No. 4,342,823, which is a continuation of Ser. No. 570,865, Apr. 23, 1975, abandoned, which is a division of Ser. No. 338,905, Mar. 7, 1973, Pat. No. 3,916,827.

[51] Int. Cl.[3] ..... B05D 1/06

[52] U.S. Cl. ..... 430/103; 355/10; 430/119

[58] Field of Search ..... 430/103, 119; 355/10; 118/650

[56] References Cited

U.S. PATENT DOCUMENTS

| | | | |
|---|---|---|---|
| 3,096,198 | 7/1963 | Schaffert | 430/102 |
| 3,133,484 | 5/1964 | Wright | 118/650 |
| 3,263,649 | 8/1966 | Heyl et al. | 118/647 |
| 3,605,692 | 9/1971 | Maloney et al. | 118/647 |
| 3,618,567 | 11/1971 | Levy | 118/650 |
| 3,667,987 | 6/1972 | Miller | 430/118 |
| 3,669,073 | 7/1972 | Savit et al. | 118/649 |
| 3,776,630 | 12/1973 | Ohno et al. | 355/10 |
| 3,878,817 | 4/1975 | Kuehale | 118/647 |
| 4,091,404 | 5/1978 | Schörnig et al. | 354/321 |
| 4,342,823 | 8/1982 | Grant et al. | 430/103 |

*Primary Examiner*—Evan K. Lawrence

*Attorney, Agent, or Firm*—R. Duke Vickrey; John W. Kane; Francis M. DiBiase

[57] ABSTRACT

Apparatus for developing electrostatic images on electrophotographic material by means of a perforate development electrode and liquid toner, without immersing the material in a bath of toner.

1 Claim, 4 Drawing Figures

PERFORATE DEVELOPMENT ELECTRODE

This is a division of application Ser. No. 66,395, filed Aug. 14, 1979, U.S. Pat. No. 4,342,823, a continuation of Ser. No. 570,865, filed Apr. 23, 1975, abandoned, a Division of Ser. No. 338,905 filed Mar. 7, 1973, U.S. Pat. No. 3,916,827.

BACKGROUND OF THE INVENTION

1. Field of the Invention

This invention relates generally to photocopying, and is particularly concerned with image development in electrostatic photocopying equipment of the type which employs a liquid toner.

2. Description of the Prior Art

The liquid developers used in electrophotography comprise a dispersion of solid toner particles in a liquid having dielectric properties. During development, the toner particles, which bear a charge, are attracted to the electrophotographic material in accordance with the charge of the image upon it, whereas the dielectric liquid flows off. The result is a visible image.

Normally the electrophotographic material is brought into contact with the liquid developer by drawing it through a container which contains the liquid developer (a "bath"), or a thin film of liquid developer is applied to the surface of the material by spraying or by transfer roll.

An improvement in the bath type of development apparatus is described in U.S. Pat. No. 3,605,693 granted Sept. 20, 1971. This patent discloses a perforate, electrically floating electrode employed in a liquid toner bath for electrostatic image development. Such an electrode, placed in close proximity to the image-bearing surface of the electrophotographic material during development, is referred to in the art as a "development" or "developing" electrode. The essential characteristics of a developing electrode are that it is made of an electrically conductive material and is maintained in close proximity or virtual contact with the image side of the electrophotographic material. The development electrode has the advantage of overcoming the difficulty commonly known as "edge effect", the tendency of the copying process to wash out the interior of an extended black area of the image, coloring only the edges of that area black. This is especially important when the electrophotographic material is intended for use as a lithographic printing plate, because, if the image formed on the printing plate exhibits this edge effect, the defect will be transferred to all copies made from the plate.

While the development electrode described in this U.S. Pat. No. 3,605,693 may be capable of producing high quality electrostatic reproductions, the bath type of developer suffers from several disadvantages, particularly when the imaged material is paper. When the sheet is immersed in the toner bath, it absorbs or picks up a considerable amount of carrier liquid for the toner particles and carries the liquid with it from the bath. This amount of liquid must then be evaporated from the sheet. This evaporation requires energy and time for drying the sheet, and replenishment of the bath. Furthermore, maintenance of the "virtual contact" between the paper and the stationary electrode while guiding the paper through the arc which it must transverse through the bath is very difficult to achieve. As a practical matter, the result is often actual contact. The sliding contact between the image-bearing surface of the copy paper and the development electrode produces a smearing of toner particles across the image-bearing surface of the copy paper, visible as distinct black smear lines which are highly objectional. Any attempt to avoid smearing by widening the space between the copy paper and the development electrode reduces its effectiveness in eliminating edge effect.

SUMMARY OF THE INVENTION

Accordingly, it is an object of this invention to alleviate a number of the difficulties encountered in the use of bath-disposed development electrodes.

In accordance with the present invention, at a point in the copying apparatus after the exposure or imaging station, a perforate development electrode is placed across the width (the dimension perpendicular to the direction of travel) of the imaged material. Liquid toner is delivered uniformly through the development electrode. After the toner flows over the imaged material, it is collected and recirculated.

This invention is directed to apparatus for developing images on material provided with an electrophotographic surface, irrespective of the substrate. In particular, copy paper and substrates adopted for use as lithographic printing plates are contemplated.

DETAILED DESCRIPTION OF THE INVENTION

Figure 1:
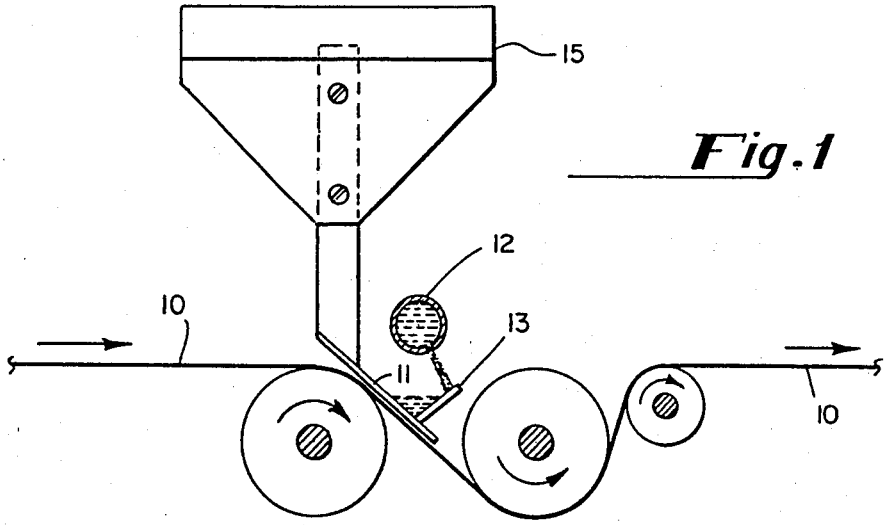
FIGS. 1 and 2 are side-elevational views of alternative forms of developing apparatus according to the invention.

The apparatus shown in FIG. 1 includes electrophotographic material 10, which has a latent charge image on its upper surface and is fed beneath the perforate development electrode 11. While passing beneath the electrode, the material is brought into contact with liquid toner flowing through the electrode. The toner is supplied through spray means in the form of a perforated tube 12 which directs the liquid against a baffle 13, adjacent the electrode 11, which reduces and makes uniform the pressure, thus providing uniform flow of the liquid over and through the electrode.

The spray tube 12 is provided with either a row of holes or a slit along its length to allow the toner to either spray or squirt against the pressure reducing plate 13. Both the tube 12 and the plate 13 are preferably of the same length as the electrode 11 and may be fabricated from any suitable material. Toner accumulates in the space formed between the plate 13 and the electrode 11 and flows uniformly through the perforate electrode 11 onto the image side of the sheet without contacting the side opposite the image side.

The development electrode must of course be formed of electrically conductive material, but must also be sufficiently porous to be readily permeable to the toner particles and the carrier fluid. A screen comprised of a network of relatively fine metal wires with sufficiently large spaces therebetween to provide a high degree of permeability to the toner bath may be employed. A metal plate perforated with holes of uniform size and distribution can also be utilized.

The diameter of the holes in the electrode should be the same order of magnitude as the distance between the electrode and the sheet. By way of example, if such distance is 0.030 inch, the holes would be smaller than 0.10 inch and preferably in this case, smaller than 0.030. Especially preferred for use at said distance is a brass plate having holes 0.016 inch in diameter and having 1479 such holes per square inch or about 301 open area.

Typically the length (i.e., the dimension in the direction of travel of the sheet), of the development electrode is from 0.75 to 6 inches. This dimension is dependent on a variety of variables. These include the composition of the toner, its concentration, the nature of the electrophotographic material, the rate of travel of the sheet past the electrode, and the distance between the sheet and the electrode—in general, the closer the electrode is to the sheet, the shorter the electrode may be. As will be appreciated by those skilled in the art, the closeness of the electrode to the sheet is limited by practical considerations such as maintenance of a gap to prevent scratches and the problem that if the electrode is too close the rate of depletion of the toner will exceed the rate at which it can be supplied through the available space. The general considerations which apply to the length of the electrode are that as length is increased, it becomes more difficult to maintain a uniform distance between the electrode and the sheet and that as the length is decreased, other things being equal, the rate of travel of the imaged material must be reduced.

Figure 2:
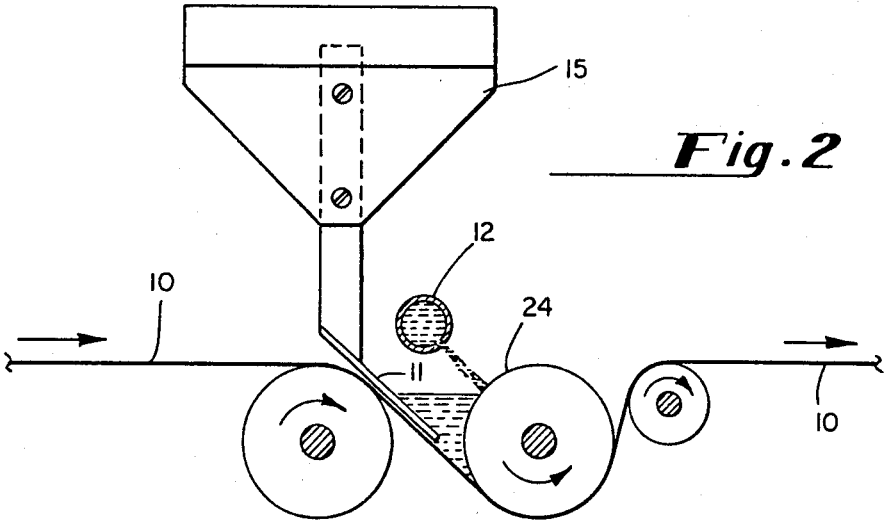

A modification of the embodiment shown in FIG. 1 is presented in FIG. 2, in which the baffle 13 has been omitted. The spray means 12 directs liquid toner against the adjacent guide roll 24. Toner accumulates in the nip formed between the roll 14 and the sheet 10 to a height appropriate to cover the electrode 11 and flows through it onto the image side of the sheet without contacting the side opposite the image side.

The electrode may be the "floating" variety on which a complementary potential is developed by virtue of its proximity to the charged surface of the electrophotographic material, or may be used as a "biased" electrode on which a fixed potential is impressed from a separate source. In either case, the electrode must be electrically isolated from other portions of the machine in which it is employed. A still further alternative is that the electrode be grounded. The accomplishment of these electrical arrangements is well within the skill of the person of ordinary skill in the art to which this invention pertains. An illustrative means of mounting the electrode is depicted in FIGS. 1 and 2 in which the electrode 11 is suspended from the post and bracket assembly 15.

After leaving the development electrode, excess toner is removed from the surface of the sheet by suitable apparatus. By way of illustration, in the apparatus shown in FIGS. 1 and 2 the metal idler roll 24 suffices. In the apparatus depicted in FIGS. 3 and 4, the imaged material passes between two resilient rolls which gently squeeze off the toner liquid.

The toner liquid flows off the edges of the imaged material into a tray, not shown, and thence to a tank from which it is recirculated by a pump to the spray tube 12.

Figure 3:
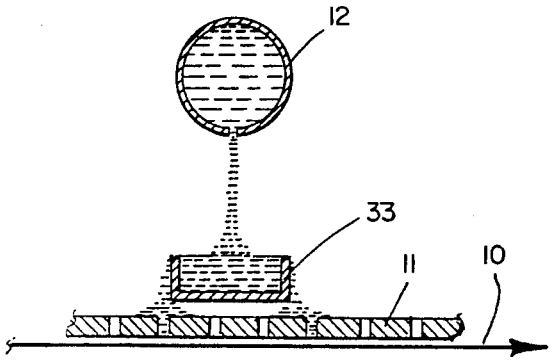
FIGS. 3 and 4 are fragmentary sectional views of other forms of developing apparatus according to the invention.

Referring now to FIG. 3, the flat baffle 13 of FIG. 1 is replaced by channel shaped baffle 33 disposed between the tube 12 and the electrode 11. The channel is filled to overflowing by the spray tube 12 and the toner liquid flows downward and outward uniformly across the development electrode 11 and through the holes therein onto the image side of the sheet without contacting the side opposite the image side. In the construction of this apparatus, the baffle 33, the electrode 11 and the sheet 10 are disposed in the horizontal plane.

Figure 4:
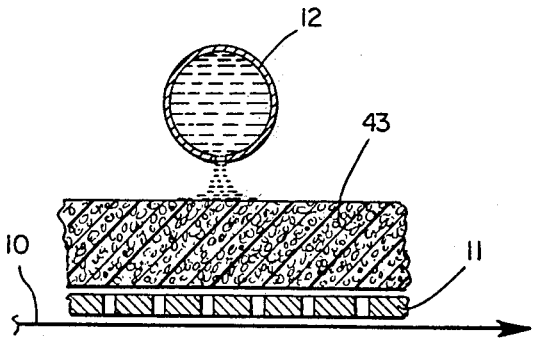

Referring now to FIG. 4, the channel shaped baffle 33 of FIG. 3 is replaced by a block 43 of reticulated polyurethane foam, described in U.S. Pat. No. 3,171,820 (Volz). The foam breaks up the flow of the liquid, causing it to be well distributed before it reaches the surface of the imaged material. The pore size of the foam should be as fine as possible consistent with the requirement that the pores be sufficiently large to permit the ready passage of the toner particles. Obviously, the choice of pore size will depend upon the maximum size of the particles in the toner desired to be used.

The apparatus of the present invention provides several advantages over the bath or immersion type of development electrodes of the prior art. The latter generally requires a curved path of movement of the electrophotographic material, which renders difficult the control of the spacing between the material and the electrode. The prior art discloses stationary electrodes disposed in a bath in "virtual contact" with sheets sliding past the electrode. Practically, unless the separation is fairly large, actual contact occurs, with smears and streaks resulting. The planar or flat electrode arrangement provided by the present invention permits a planar alignment of the material, by which the proximate relationship between the material and the electrode is more easily maintained. In addition, since in accordance with the present invention, toner is applied to only one side of the sheet, less toner-carrying fluid is carried away from the development station on the sheet than is the case in bath arrangements, and therefore, there is less need to replenish the toner. Furthermore, since there is less toner-carrying fluid on the sheet, the requirements for drying are less.

It is apparent that other variations and modifications may be made without departing from the present invention. In the embodiments illustrated, toner is delivered to the vicinity of the electrode by a tube which squirts toner against pressure reducing means disposed close to the electrode and which reduces and makes uniform the pressure, thus providing uniform flow of the liquid over and through the electrode. Other arrangements or constructions for delivering liquid toner uniformly through the development electrode are deemed to be within the skill of those of ordinary skill in the art to which the present invention pertains. Accordingly, it should be understood that the forms of the present invention described above and shown in the accompanying drawing are illustrative only and not intended to limit the scope of the invention.

What is claimed is:

1. A method for developing electrostatic images on a sheet of electrophotographic copy material comprising the steps of moving the copy material sheet past and separated from a perforate development electrode of the type used to eliminate edge effect in a path of uniform distance from the electrode and simultaneously delivering liquid toner at a reduced and uniform pressure uniformly through the perforate development electrode and onto the image side of the sheet without contacting the side opposite the image side with the toner.

* * * * *